US011825890B1

(12) United States Patent
He

(10) Patent No.: US 11,825,890 B1
(45) Date of Patent: Nov. 28, 2023

(54) WEARABLE BLANKET

(71) Applicant: NINGBO DINGQUAN JIENENG KEJI CO., LTD, Ningbo (CN)

(72) Inventor: Yufan He, Ningbo (CN)

(73) Assignee: NINGBO DINGQUAN JIENENG KEJI CO., LTD, Ningbo (CN)

( * ) Notice: Subject to any disclaimer, the term of this patent is extended or adjusted under 35 U.S.C. 154(b) by 0 days.

(21) Appl. No.: 18/080,055

(22) Filed: Dec. 13, 2022

(51) Int. Cl.
*A41D 15/04* (2006.01)
*A47G 9/02* (2006.01)
*A47G 9/00* (2006.01)

(52) U.S. Cl.
CPC ..... *A41D 15/04* (2013.01); *A47G 9/0223* (2013.01); *A47G 2009/005* (2013.01)

(58) Field of Classification Search
CPC ..... A41D 10/00; A41D 15/04
USPC ..... 2/83
See application file for complete search history.

(56) References Cited

U.S. PATENT DOCUMENTS 4,998,296 A * 3/1991 Stames ..... A41D 31/102 2/84
5,023,952 A * 6/1991 Palmer ..... A41B 13/005 2/69
5,226,193 A * 7/1993 Chen ..... A47G 9/083 2/69.5
6,266,822 B1 * 7/2001 Joyce ..... A47G 9/083 2/69.5
D721,467 S * 1/2015 Tref ..... D2/724
9,003,564 B2 * 4/2015 Wynh ..... A41B 13/06 2/83
D734,592 S * 7/2015 Castillo ..... D2/719
10,076,197 B2 * 9/2018 Montanari ..... A42B 1/24
2003/0019009 A1 * 1/2003 Feduzi ..... A41D 31/102 2/69
2009/0064390 A1 * 3/2009 Beiring ..... A41B 13/06 2/243.1
2009/0241234 A1 * 10/2009 Coles ..... A41D 13/01 2/244
2014/0165257 A1 * 6/2014 Wynh ..... A41B 13/06 2/69.5
2019/0269186 A1 * 9/2019 Merritt ..... G09B 1/02

* cited by examiner

*Primary Examiner* — Gloria M Hale
(74) *Attorney, Agent, or Firm* — Daniel M. Cohn; Howard M. Cohn

(57) ABSTRACT

A wearable blanket includes a blanket body. The blanket body includes a main body portion configured to wrap a trunk of a human body, a cap portion configured to wrap a head of the human body, and two sleeve portions configured to wrap arms of the human body. The cap portion is connected to a top hem of the main body portion. The sleeve portions are respectively connected to a left side and a right side of the main body portion. At least one partial area of the outer surface of the blanket body is coated with a fluorescent material. An outer surface of the blanket body defines a plurality of patterned areas. At least one of the plurality of patterned areas is coated with the fluorescent material.

6 Claims, 2 Drawing Sheets

WEARABLE BLANKET

TECHNICAL FIELD

The present disclosure relates to a field of blanket technology, and in particular to a wearable blanket capable of glowing in the dark.

BACKGROUND

Blankets are common bedding and have a warm-keeping function. Compared with quilts, blankets are relatively light. However, people may easily kick off the blanket when they are asleep, causing people to catch a cold due to the drop in the temperature at night. Further, if the blankets have the capability of glowing in the dark, the blankets would be more enjoyable for the consumers.

However, conventional blankets do not have a wearable function and are unable to glow in the dark, which is unable to meet user requirements.

SUMMARY

In view of defects in the prior art, the purpose of the present disclosure is to provide a wearable blanket capable of glowing in the dark. The wearable blanket effectively solves the problem that people may not stay well under conventional blankets and the conventional blankets do not have a glowing function.

In order to realize the above purpose, the present disclosure provides the wearable blanket.

The wearable blanket comprises a blanket body. The blanket body comprises a main body portion configured to wrap a trunk of a human body, a cap portion configured to wrap a head of the human body, and two sleeve portions configured to wrap arms of the human body. The cap portion is connected to a top hem of the main body portion. The sleeve portions are respectively connected to a left side and a right side of the main body portion. At least one partial area of an outer surface of the blanket body is coated with a fluorescent material.

Optionally, the outer surface of the blanket body defines a plurality of patterned areas. At least one of the plurality of patterned areas is coated with the fluorescent material.

Optionally, the plurality of patterned areas is defined on an outer surface of the main body portion, an outer surface of the cap portion, and an outer surfaces of the sleeve portions.

Optionally, an inner surface of the blanket body and the outer surface of the blanket body are fuzzy structures.

Optionally, the main body portion is an elongated structure capable of wrapping thighs or calves of the human body.

Optionally, pockets are arranged on a left side and a right side of the front side of the main body portion.

Optionally, the main body portion is a widened structure.

Compared with the prior art, the blanket body composed of the main body portion, the cap portion, and the sleeve portions is wearable on the human body, so that the user is unable to kick away the wearable blanket while sleeping. Thus, the wearable blanket is fully used and plays a good warm effect. Furthermore, the fluorescent material is coated on at least one partial area of the outer surface of the blanket body. The wearable blanket is capable of glowing in the dark with fluorescent material. The wearable blanket acts as a bright protective shield, making some children and adults feel secure when falling asleep. Further, the feature of glowing in the dark of the wearable blanket provides enjoyment for users and meets user requirements.

10—blanket body; 11—main body portion; 12 cap portion; 13—sleeve portion; 101—pocket; 102—patterned area; 20—fluorescent material.

DETAILED DESCRIPTION

Figure 1:
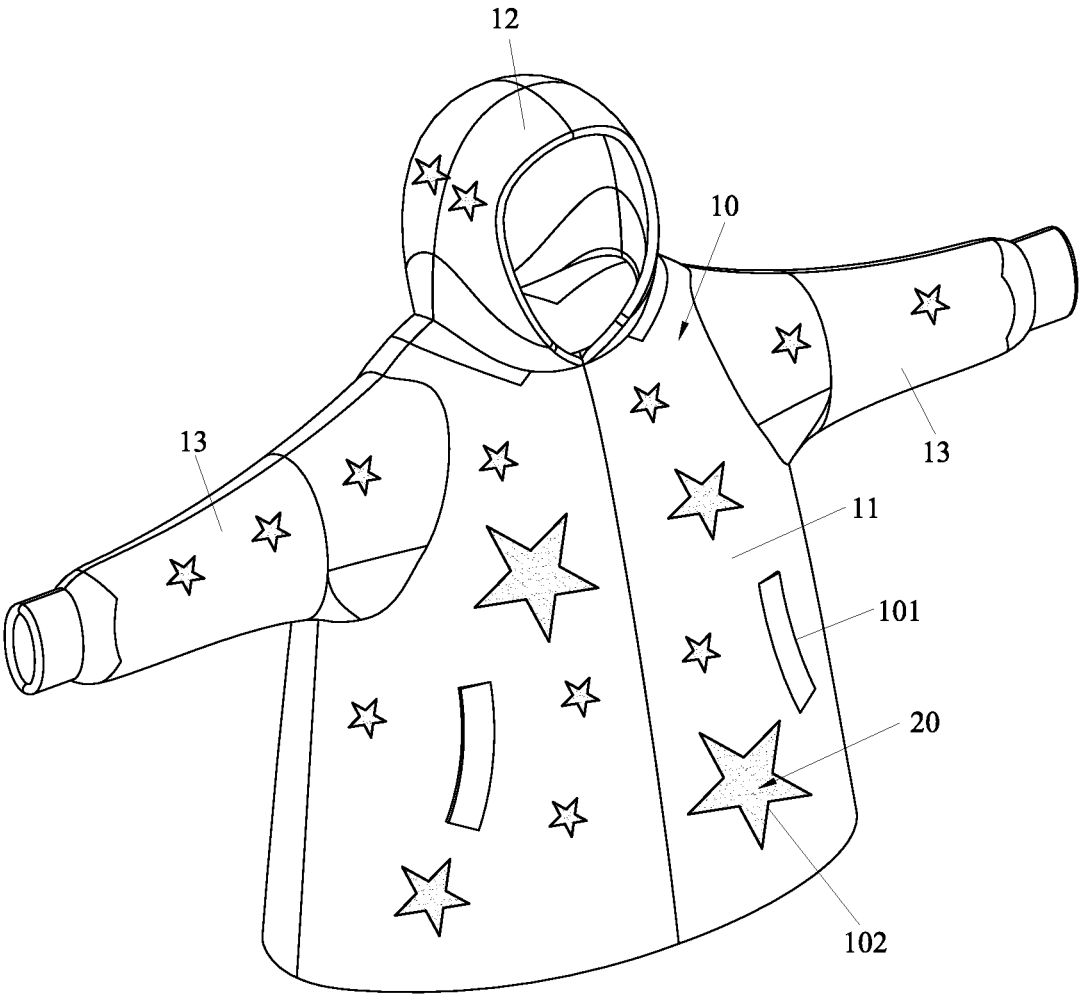
FIG. 1 is a schematic diagram of a wearable blanket according to a first embodiment of the present disclosure.

As shown in FIG. 1, in a first embodiment of the present disclose, a structure of a wearable blanket capable of glowing in the dark is shown. The wearable blanket comprises a blanket body 10. The blanket body 10 comprises a main body portion 11 configured to wrap a trunk of a human body, a cap portion 12 configured to wrap a head of the human body, and two sleeve portions 13 configured to wrap arms of the human body. In the embodiment, an inner surface of the blanket body 10 and an outer surface of the blanket body 10 are fuzzy structures, which are comfortable and warm to wear. Pockets 101 are arranged on a left side and a right side of the front side of the main body portion 11. The pockets are configured to store small items such as a smartphone, which brings convenience to the user. In one embodiment, a maximum circumference of the main body portion ranges from 50-64 inches. Optionally, the maximum circumference of the main body portion is 64 inches. That is, the main body portion 11 is a widened structure, which is suitable for an obese user to wear. Of course, the maximum circumference of the main body portion may be adjusted according to actual requirements, which is not limited thereto. In one embodiment, a length of the main body portion ranges from 30.5-47.5 inches. Optionally, the length of the main body portion is 30.5 inches, and the wearable blanket wraps up to buttocks of the human body. The cap portion 12 and the two sleeve portion 13 are integrally connected to the main body portion 11 to form a stable structure.

At least one partial area of the outer surface of the blanket body 10 is coated with a fluorescent material 20. In the embodiment, the outer surface of the blanket body 10 defines a plurality of patterned areas 102. At least one of the plurality of patterned areas 102 are coated with the fluorescent material 20.

Further, the plurality of patterned areas 102 is defined on an outer surface of the main body portion 11, an outer surface of the cap portion 12, and outer surfaces of the sleeve portions 13.

The wearable blanket of the present disclosure has an oversized comfortable design that perfectly fits the user's shape and size. The user can take the wearable blanket to outdoor barbecues, camping trips, beaches, or drive for overnight stays. The wearable blanket of the present disclosure may be given as a gift to surprise adults or kids on Christmas, Halloween, Easter, Thanksgiving, birthday, or any other occasion. The fluorescent material 20 allows the wearable blanket of the present disclosure to emit a shimmering glow that inspires interesting ideas for users. Whether spending the night out, playing, or just snuggling up on a sofa with family, wearing the wearable blanket enables the users to bask in the shimmering glow.

By exposing the wearable blanket to the sun for 20 minutes, the wearable blanket is able to glow in the dark for at least three hours via the fluorescent material 20. The wearable blanket is mainly made of super soft flannel and warm Sherpa wool. The wearable blanket resists fading and stains well. Optimal long-term care is realized by simply washing the wearable blanket in a washing machine and tumble drying the wearable blanket in an air dryer at a low temperature.

Figure 2:
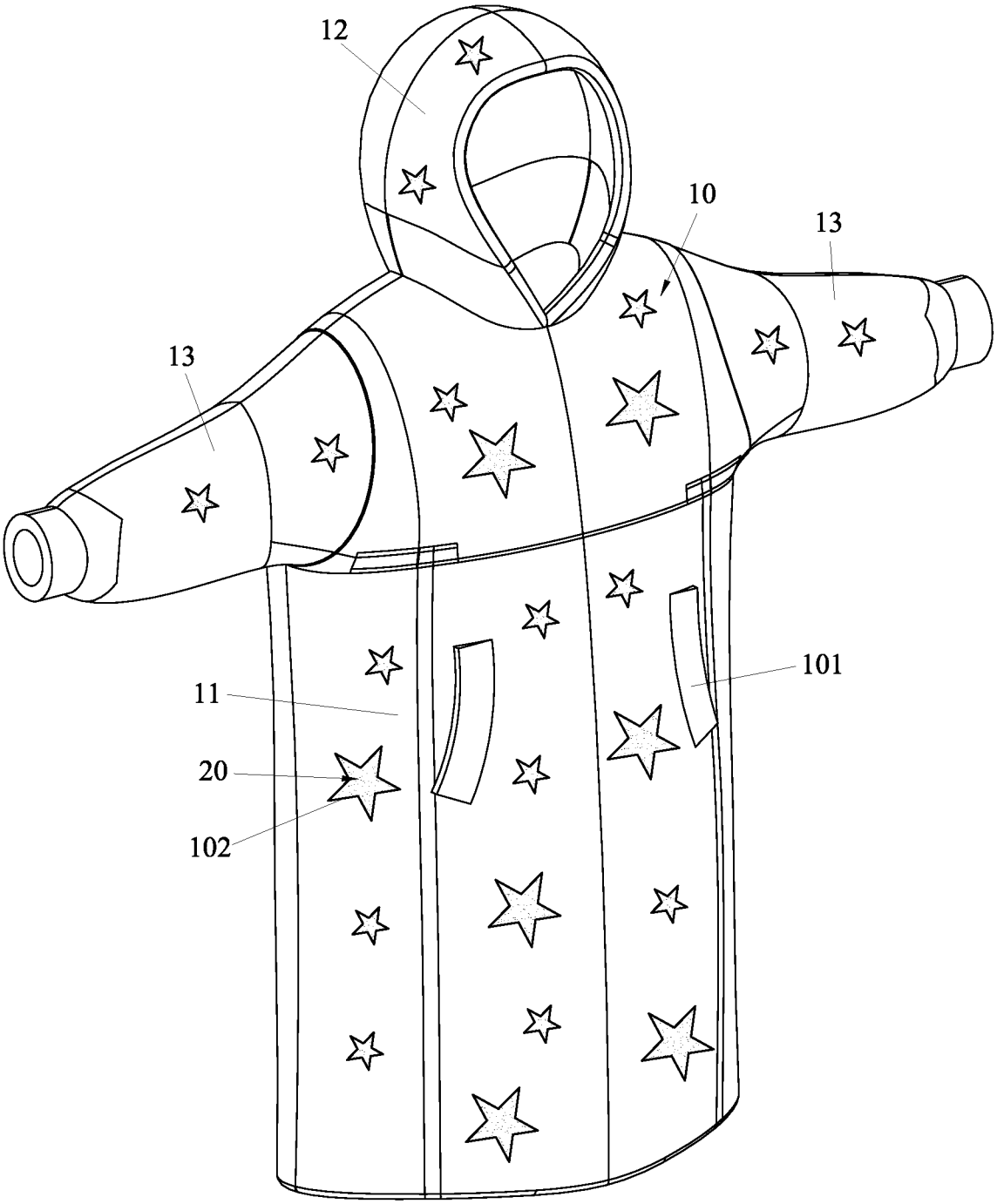
FIG. 2 is a schematic diagram of the wearable blanket according to a second embodiment of the present disclosure.

As shown in FIG. 2, in a second embodiment of the present disclose, the structure of the wearable blanket capable of glowing in the dark is shown. The structure of the wearable blanket of the second embodiment is generally the same as the wearable blanket of the first embodiment. A difference between the two embodiments is that in the second embodiment, the main body portion 10 is an elongated structure. Specifically, the length of the main body portion is 47.5 inches, so the main body portion is capable of wrapping the thighs or calves of the human body, which is suitable for tall people to wear. The wrapping range of the wearable blanket varies by the different heights of different users. The wearable blanket may be wrapped up to the calves of some users having a short height. Of course, the length of the wearable blanket may be adjusted according to actual requirements, which is not limited thereto. Further, the blanket has a loose structure, which is comfortable to wear.

The blanket body is composed of the main body portion, the cap portion, and the sleeve portion and is wearable on the human body, so the user is unable to kick away the wearable blanket while sleeping. Thus, the wearable blanket is fully used and plays a good warm effect. Furthermore, the fluorescent material is coated on at least one partial area of the outer surface of the blanket body. The wearable blanket is capable of glowing in the dark with fluorescent material. The wearable blanket acts as a bright protective shield, making some children and adults feel secure when falling asleep. Further, the feature of glowing in the dark of the wearable blanket provides enjoyment for users and meets user requirements.

The above descriptions describe the technical principle of the present disclosure in combination with specific embodiments. These descriptions are only for explaining the principles of the present disclosure, and cannot be interpreted as limiting the protection scope of the present disclosure in any way. Based on the explanations, any modification, equivalent replacement, and improvement made within the spirit and principle of the present disclosure, and other specific implementations of the present disclosure obtained by those skilled in the art without creative work, should fall within the protection scope of the present disclosure.

What is claimed is:

1. A wearable blanket, comprising:

a blanket body;

wherein the blanket body comprises a main body portion configured to wrap a trunk of a human body, a cap portion configured to wrap a head of the human body, and two sleeve portions configured to wrap arms of the human body; the cap portion is connected to a top hem of the main body portion; the sleeve portions are respectively connected to a left side and a right side of the main body portion; at least one partial area of an outer surface of the blanket body is coated with a fluorescent material, and wherein an inner surface of the blanket body and the outer surface of the blanket body are fuzzy structures, when the wearable blanket is exposed to a sun for 20 minutes, the wearable blanket glow in the dark for at least three hours via the fluorescent material.

2. The wearable blanket according to claim 1, wherein the outer surface of the blanket body defines a plurality of patterned areas; at least one of the plurality of patterned areas is coated with the fluorescent material.

3. The wearable blanket according to claim 2, wherein the plurality of patterned areas is defined on an outer surface of the main body portion, an outer surface of the cap portion, and outer surfaces of the sleeve portions.

4. The wearable blanket according to claim 1, wherein a length of the main body portion ranges from 30.5-47.5 inches.

5. The wearable blanket according to claim 1, wherein pockets are arranged on a left side and a right side of the front side of the main body portion.

6. The wearable blanket according to claim 1, wherein a maximum circumference of the main body portion ranges from 50-64 inches.

* * * * *